United States Patent [19]

Steiner et al.

[11] 3,948,714

[45] Apr. 6, 1976

[54] LARGE-AREA REFLECTORS FROM PLASTICS

[75] Inventors: Fritz Steiner, Wagshurst; Hans-Erich Gubela, Wuppertal-Barmen; Hans-Erich Gubela, Sasbachwalden, all of Germany

[73] Assignee: Firma Hans Gubela, Cologne, Germany

[22] Filed: May 23, 1973

[21] Appl. No.: 363,175

[52] U.S. Cl. ..... 156/245; 76/107 R; 264/1; 264/219; 350/103

[51] Int. Cl.[2] ..... B29C 27/02; B29D 11/00

[58] Field of Search ..... 264/1; 76/107 R; 350/103, 350/102; 156/242, 306, 245

[56] References Cited

UNITED STATES PATENTS 2,205,638 6/1940 Stimson ..... 264/1

2,538,638 1/1951 Wilson ..... 264/1

OTHER PUBLICATIONS

A.P.C. Application of D. Swarovski, Ser. No. 322,151, Published May 4, 1943.

*Primary Examiner*—Robert F. White
*Assistant Examiner*—Gene Auville
*Attorney, Agent, or Firm*—Darbo, Robertson & Vandenburgh

[57] ABSTRACT

A large area reflector of the type having a plurality of triples is assembled from a plurality of individual units of identical configuration, each unit having a plurality of triples thereon. The borders of each of the units correspond to edges of triples and each border is complementary to the opposite border of the unit.

2 Claims, 12 Drawing Figures

LARGE-AREA REFLECTORS FROM PLASTICS

The present invention relates to a method of manufacturing large-area reflectors from plastics which comprise a plurality of closely adjoining triples of which each is formed by three reflecting cube surfaces constituting a corner on the back of the reflector, in which the large-area reflector is assembled from individual flat plastic molded parts of which each still contains a plurality of triples.

Reflectors of the indicated type are, for instance, used to manufacture reflex-reflecting traffic signs or the like, or also in photoelectric devices, such as light barriers for accident prevention. In prior art large-area reflectors the individual plastic molded parts from which the reflectors are made, are provided with smooth straight rims and have, for instance, the shape of rectangles or regular hexagons. Therein, along the rims of the individual plastic molded parts dark non-reflecting strips occur. This is due to the fact that at the rims triples are necessarily cut and then, do not reflect anymore. In reflex-reflecting signs this leads to an ugly structure on the sign. In photoelectric devices in which, say, a moving light ray is periodically passed across the reflector, the dark rims of the individual plastic molded parts result in an undesirable signal noise. The manufacture of large-area reflectors from one piece involves considerable manufacturing difficulties.

It is therefore an object of the present invention to provide a method of manufacturing large-area reflectors from individual plastic molded parts, leading to reflectors with a uniformly continuous reflecting reflector surface.

The method according to the present invention is characterized in that plastic molded parts are manufactured whose rims extend along cube edges which do not contact the corner constituted by the three cube surfaces, and that the plastic molded parts are joined together with the rims engaging each other complementarily.

If the rims of the individual plastic molded parts extend in zig-zag fashion in the manner as described, then along each rim only complete triples of full reflecting effect will be obtained. If these plastic molded parts are joined together with their rims engaging each other complementarily — which is possible — then finally, a large-area reflector of uniform reflecting power across the total surface and without dark rims will be obtained.

For reflectors of the type indicated, generally, an injection mold is used in which the structure complementary to the triples is produced by means of adjacently placed, very accurately ground or drawn, regularly hexagonal prism studs terminating in a three-sided pyramid having three square surfaces being vertical with respect to each other.

A device for carrying out the method according to the present invention preferably includes an injection mold for the plastic molded parts, which is designed in accordance with the above principle and is characterized in that there are provided prism studs of rhombic cross-section of which three equal ones can be assembled to the configuration of a hexagonal stud with three-sided pyramid and that one such rhombic prism stud is mounted to a rim of the injection mold adjoining two respective adjacent hexagonal studs, and at the opposite rim two respective rhombic prism studs are mounted.

Another device including an injection mold of the type mentioned hereinbefore is characterized in that there are provided prism studs of rhombic cross-section of which three equal ones can be assembled to the configuration of the hexagonal stud with three-sided pyramid, wherein at the rims hexagonal studs projecting and recessed with three side surfaces are arranged adjoining each other alternatingly in the injection mold plane, and that the arrangements at opposite rims of the injection mold are complementary to each other and two respective prism studs of rhombic cross-section join the respective hexagonal projecting studs towards the rim thereof, and a respective third prism stud of rhombic cross-section joins each recessed hexagonal stud and one of the projecting hexagonal studs adjacent thereto.

It is furthermore possible that an electroplating mold is produced electrolytically and used to manufacture the plastic molded parts. In this connection, an electroplating mold can be produced from a reflector and then the rims thereof can be worked as by cutting for producing a meshing toothing.

The plastic molded parts can be mirror-plated in the high-vacuum on the back constituting the triples. Then it is possible that the mirror-plated back is subsequently made weather-proof as by varnishing or is provided with a plastic coating. In the plastic coating inserts of plastic or metal can be embedded. Another possibility of the back covering consists in that the mirror-plated, and, maybe, varnished or plastic-coated backs of the plastic molded parts are provided with a cover plate of plastic or metal. Finally, there exists the possibility that the plastic molded parts assembled to a large-area reflector are mounted in a flat, tightly sealed housing whose cover (disk) consists of glass or transparent plastic. The plastic molded parts may be assembled to multi-cornered, for instance, to triangular or rectangular surfaces. The plastic molded parts can be joined together as by welding.

Furthermore, to the rims of a large-area reflector comprised of toothed plastic molded parts with complementarily toothed internal rims, however smooth external rims may be mounted which, for instance, allow a cementing or welding at their rim.

An illustrative embodiment of the present invention will now be described more fully with reference to the accompanying drawings in which.

Figure 1:
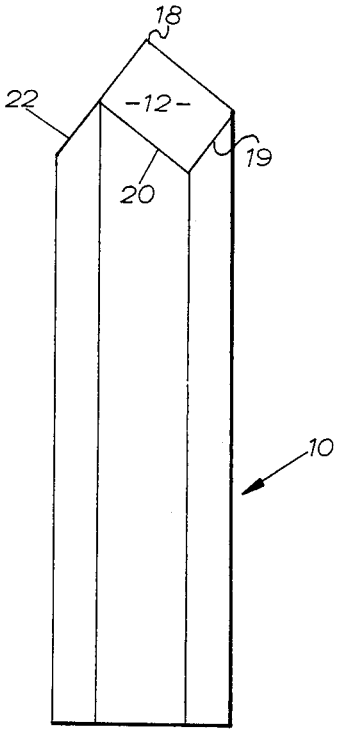
FIG. 1 is a side elevational view of a hexagonal stud utilized in forming the injection mold for the individual plastic molded parts.
Figure 2:
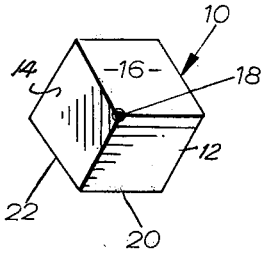
FIG. 2 is a respective top view thereof.
Figure 3:
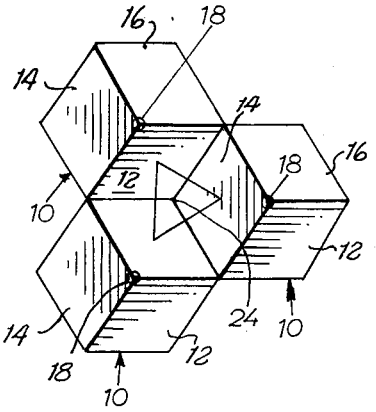
FIG. 3 illustrates the manner in which a reflex-reflecting triple can be injected as solid totally reflecting body between three such hexagonal studs.

The hexagonal stud 10 of FIG. 1 has a regularly hexagonal cross-section below. At the top it ends in a three-sided pyramid which is constituted by three square surfaces 12, 14, 16 vertical to each other and so-to-speak form a cube corner in point 18. Surfaces 12, 14 and 16 do not appear to be square in FIG. 2 because of the viewing angle. When viewed normal to its surface, each will be seen to be a square. The surfaces 12, 14, 16 form six alternatingly upwardly and downwardly extending edges, for instance 19, 20, 22 in FIG. 1 with the side surfaces of the hexagonal prism stud 10. Three such hexagonal studs 10 joined together constitute a cubical recess in the injection mold, as is illustrated in FIG. 3, with interposed projecting cube corners 18 and a low-lying cube corner 24. This recess is filled out during the injection process and constitutes a triple element projecting from the back of the reflector, whose three sides are totally reflecting.

Figure 4:
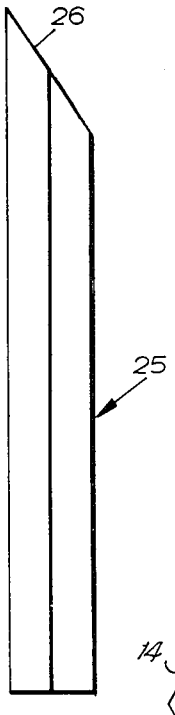
FIG. 4 illustrates a side elevational view of a rhombic prism stud utilized in forming an injection mold in accordance with the present invention.
Figure 5:
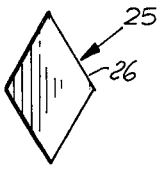
FIG. 5 is a respective top view thereof.
Figure 6:
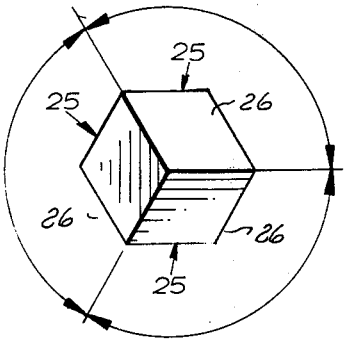
FIG. 6 illustrates the manner in which three rhombic prism studs according to FIGS. 4 and 5 are being assembled to the configuration of a hexagonal stud according to FIG. 2.

FIG. 4 illustrates a prism stud 25 of rhombic cross-section (FIG. 5) with a square inclined surface 26 on a front face. As can be seen from FIG. 6, the rhombic prism stud 25 has been produced by division of the hexagonal stud 10 into three equal parts, respectively three such equal prism studs 15 can be combined to the configuration of the prism stud 10.

Figure 7:
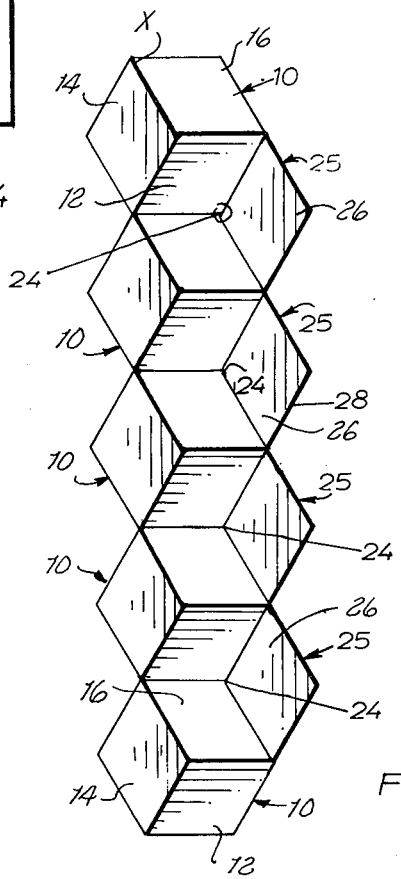
FIG. 7 illustrates a rim of the injection mold when using the method according to the present invention.
Figure 8:
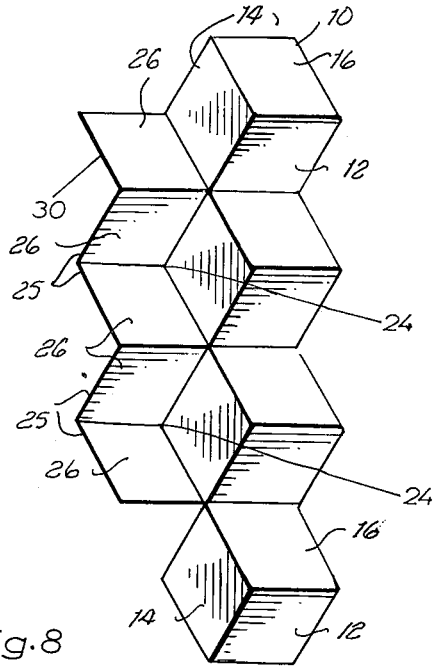
FIG. 8 illustrates the opposite complementary rim.

These rhombic prism studs 25 are used in the manufacture of the injection mold in the form obvious from FIGS. 7 and 8:

At the one rim 28 (FIG. 7) of the mold a respective rhombic prism stud 25 is positioned between two neighboring hexagonal prism studs 10. In this manner along the total rim of the resultant molded plastic part, complete triple elements are formed whose points respectively lie in the lower point 24 of the mold. The rim itself becomes slightly zig-zag shaped.

At the other rim 30 (FIG. 8) of the mold two respective rhombic prism studs 25 are positioned between two neighboring hexagonal studs 10. Here too, the hexagonal studs 10 form complete triple elements together with the rhombic prism studs 25, wherein the points of the resultant plastic parts respectively lie again in the point 24 which is deepest in the mold.

The rims 28 and 30 of the mold are complementary and will fit together to produce a continuous triple pattern. The same, of course, applies then to the plastic molded parts made therefrom.

Figure 9:
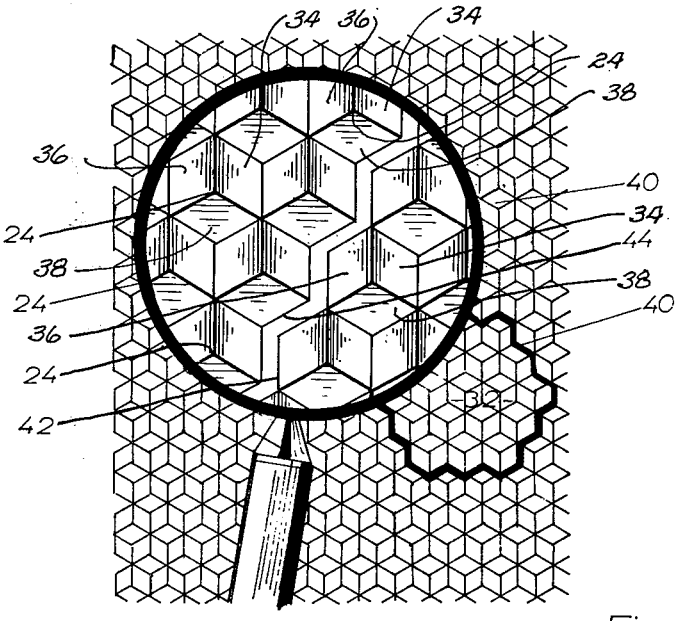
FIG. 9 illustrates schematically a large-area reflector manufactured according to the method of the present invention.

FIG. 9 illustrates a large-area reflector manufactured in accordance with the present invention. It is made of plastic molded parts 32 which are provided with zig-zag-shaped rims or boundary lines similarly to the injection molds. Reference numeral 24 respectively designates the cube corner constituted by the three square reflecting triple surfaces 34, 36, 38, which projects from the reflector back, and the dividing line 40 extends along such cube edges 42, 44 which do not contact the cube corner 24. Thus, at both sides of the dividing line complete triples are formed which then accurately fit together so that no non-reflecting external zones are produced.

Figure 10:
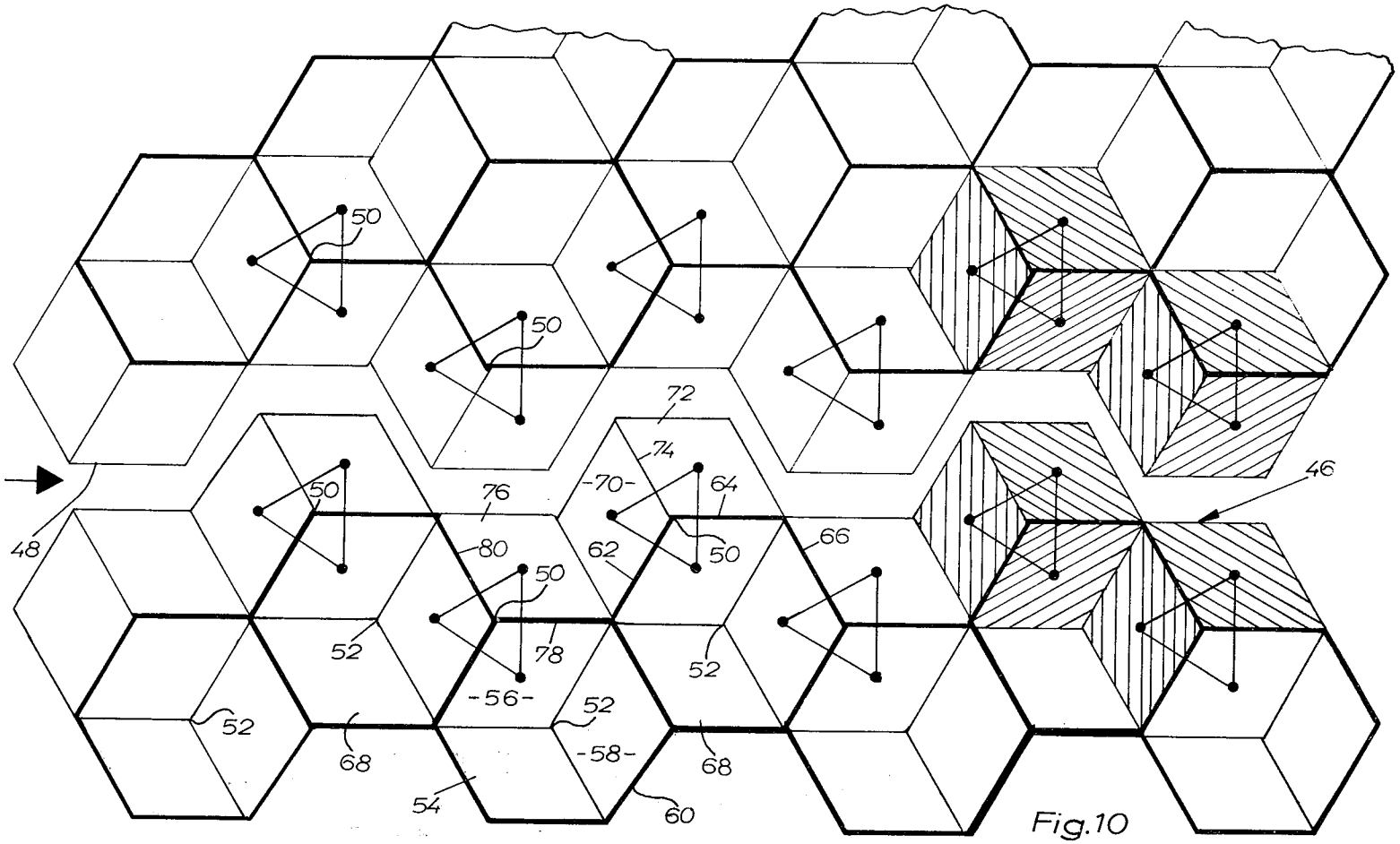
FIG. 10 illustrates a modified form of the toothed joining together of two plastic molded parts to a large-area reflector, respectively the design of an injection mold.

Another manner of how the plastic molded parts can be designed and assembled to large-area reflectors while toothed, is obvious from FIG. 10.

FIG. 10 shall first be considered as illustrating the upper edge 46 and the complementary lower edge 48 of an injection mold with which the reflex-reflecting plastic molded parts are made, the respective points 50 in the top view being disposed below (i.e., are the extremes of the depressions in the mold) and constituting the points of the triples in the molding process. The points 52 are disposed at the top (i.e., project outwardly). Similarly to FIGS. 7 and 8 the structure complementary to the triples is formed by prism studs of rhombic cross-section (corresponding to 25 in FIG. 4) which are designed so that three of them, that is for instance 54, 56 and 58, constitute a hexagonal stud, for instance 60. The hexagonal studs thus formed at the upper and lower rim 46, respectively 48 are framed by thicker lines in FIG. 10. It can be seen that at the upper rim 46 a respective hexagonal stud 68 projecting with three side surfaces 62, 64, 66 in the injection mold plane follows a reset hexagonal stud 60 which in turn follows a projecting one, a.s.o.

At the lower rim 48 of the injection mold, which in FIG. 10 is shown above the rim 46 for better illustration of the complementary design, the arrangement of the hexagonal studs is just the same, however, complementary to the arrangement at the upper rim.

In order to obtain complete triples at the rims, prism studs 70, 72 of rhombic cross-section are mounted to the projecting hexagonal studs 68 at two surfaces 62, 64 thereof. The prism studs 70, 72 abut each other with one side surface 74 each. These prism studs with their square inclined front surfaces (corresponding to 26) together with an inclined surface of the hexagonal stud 68 constitute a cube corner type recess with the point 50 producing a complete triple during the injection process.

A third prism stud 76 of rhombic cross-section abuts the hexagonal stud 60 with one side surface 78 and the next following projecting hexagonal stud 68' with the neighboring side surface 80. Here too, a cube corner type recess is constituted by the inclined square front surface of the prism stud 76 and one square inclined surface each of the hexagonal studs 60 and 68', which produces a complete triple with the point as at 50 during the injection process.

The complementary lower edge 48 of the injection mold is designed in a corresponding manner.

Now, one can realize that the edges 46 and 48 represent adjoining rims of two plastic molded parts made with the same injection mold. In this case, the points 50 become projecting cube corner points of the individual triples. It can be seen that the two rims 46 and 48 are designed exactly complementary to each other and engage each other, and that each rim is constituted by complete triples.

Figure 11:
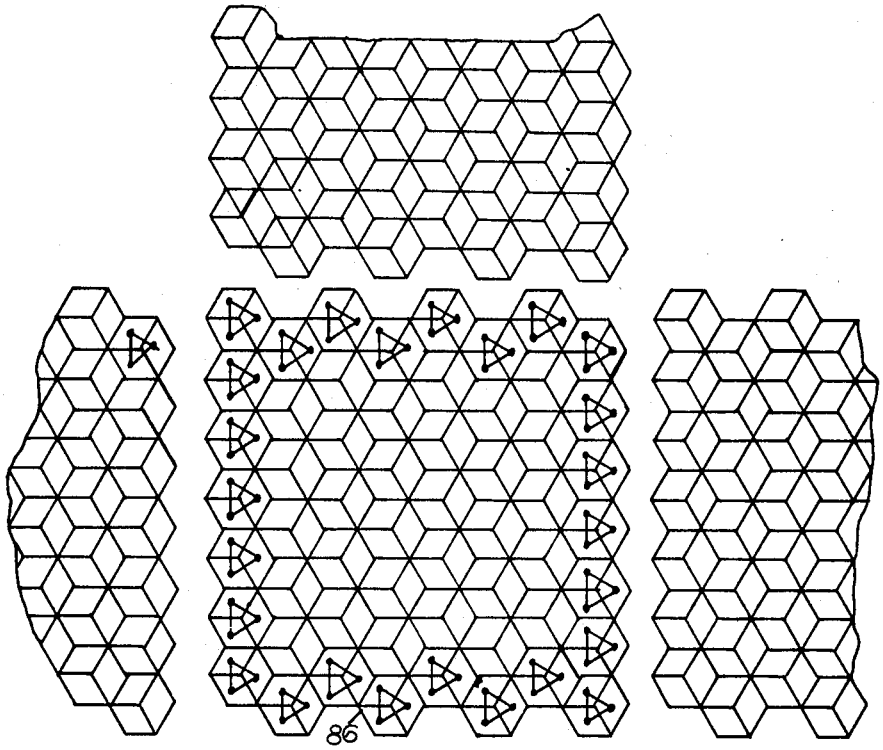
FIG. 11 illustrates the assembly of rectangular plastic molded parts.
Figure 11:
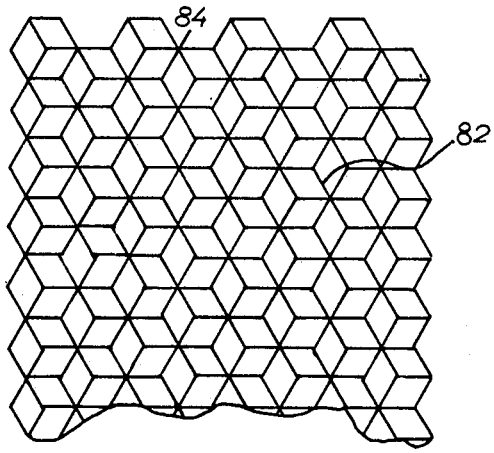
Figure 12:
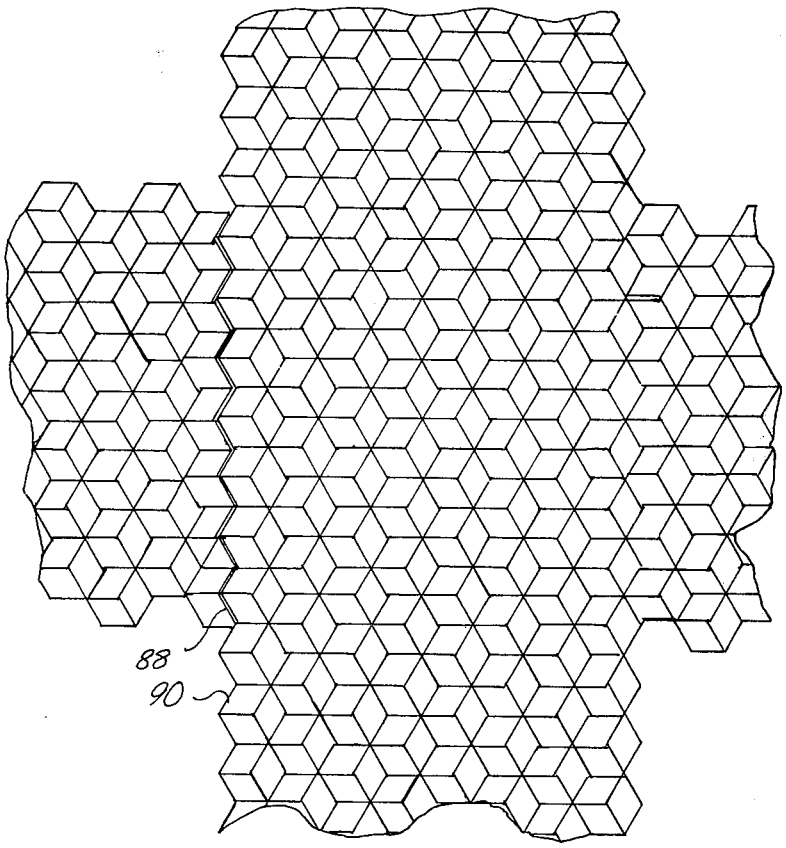
FIG. 12 illustrates the parts in an assembled state.

FIGS. 11 and 12 illustrate the assembly of large-area reflectors from rectangular plastic molded parts 82 according to the present invention. In the joints horizontally illustrated in FIG. 11 the plastic molded parts engage each other with their rims 84, 86 in the manner of FIG. 10 (i.e. 84 and 86 correspond to 46 and 48 respectively). In the joints vertically illustrated in FIG. 11 engagement of the rims 88, 90 is effected in the manner of FIGS. 7 to 9 (i.e., 88 and 90 correspond to 42 and 44 respectively). As can be seen from FIG. 12, thereby a continuous reflex-reflecting surface with respectively completely molded triples and without non-reflecting strips is produced.

The invention is claimed as follows:

1. A method of manufacturing large-area reflectors from plastics which reflectors comprise a plurality of closely adjoining triples of which each is formed by three reflecting square surfaces at a corner of a cube on the back of the reflector, said square surfaces having edges, said cube corner defining a point, in which the large-area reflector is assembled from a plurality of individual flat plastic molded parts of which each includes a plurality of said triples, each of said parts having a plurality of external rims characterized by the steps of:

forming said parts with the rims extending along the edges of said square surfaces and spaced from the point defined by the cube corner, and joining the plastic molded parts with the rims engaging each other complementarily.

2. A method as set forth in claim 1, including producing a mold for said parts by forming a plurality of first studs which are rhombic in transverse cross section and have a square end surface, forming a plurality of second studs which are hexagonal in transverse cross section and have an end in the form of a corner of a cube and consisting of three square surfaces; and assembling said plurality of second studs in abutting relationship and a plurality of said first studs between each adjacent pair of second studs along a first side of the mold corresponding to one of said rims, assembling a plurality of said first studs along a second side of the mold opposite said first side; and molding each of said parts with said mold.

* * * * *